US010131485B2

(12) United States Patent
Soules et al.

(10) Patent No.: US 10,131,485 B2
(45) Date of Patent: Nov. 20, 2018

(54) ICE CHEST SUSPENSION DEVICE

(71) Applicants: David Soules, Las Cruces, NM (US); Kevin Soules, Albuquerque, NM (US)

(72) Inventors: David Soules, Las Cruces, NM (US); Kevin Soules, Albuquerque, NM (US)

( * ) Notice: Subject to any disclaimer, the term of this patent is extended or adjusted under 35 U.S.C. 154(b) by 0 days.

(21) Appl. No.: 15/853,611

(22) Filed: Dec. 22, 2017

(65) Prior Publication Data

US 2018/0134477 A1 May 17, 2018

Related U.S. Application Data

(63) Continuation of application No. 14/994,129, filed on Jan. 12, 2016, now Pat. No. 9,896,259.

(60) Provisional application No. 62/104,834, filed on Jan. 18, 2015.

(51) Int. Cl.

| | |
|---|---|
| ***F25D 23/06*** | (2006.01) |
| ***B65D 81/38*** | (2006.01) |
| ***B65D 25/10*** | (2006.01) |
| ***B65D 81/24*** | (2006.01) |

(52) U.S. Cl.

CPC ..... *B65D 81/3813* (2013.01); *B65D 25/10* (2013.01); *B65D 81/24* (2013.01); *B65D 25/102* (2013.01)

(58) Field of Classification Search

CPC ..... F25D 3/08; F25D 23/066; B65D 25/16; B65D 81/265

See application file for complete search history.

(56) References Cited

U.S. PATENT DOCUMENTS

| | | | | | |
|---|---|---|---|---|---|
| 3,559,329 | A * | 2/1971 | Chiu | A01K 97/20 | 43/55 |
| 4,642,934 | A * | 2/1987 | Carlson | A01K 97/20 | 220/495.03 |
| 5,240,134 | A * | 8/1993 | McDermott | B65D 25/16 | 217/3 R |
| 5,636,524 | A * | 6/1997 | Woods | A45C 11/20 | 62/459 |
| 5,722,197 | A * | 3/1998 | Albritton | A01K 97/05 | 43/55 |
| 5,833,336 | A * | 11/1998 | Dean | D06F 95/002 | 312/293.2 |
| 5,941,408 | A * | 8/1999 | Sherman | A45C 3/04 | 220/495.01 |
| 6,067,745 | A * | 5/2000 | Adams | A01K 97/20 | 43/55 |

(Continued)

*Primary Examiner* — Bradley Duckworth
(74) *Attorney, Agent, or Firm* — Kevin Soules

(57) ABSTRACT

A means of suspending items within a transportable container, such as an environmental enclosure like a common "cooler" or "ice-chest". Inside the container, items are supported by resting on top of a shelf or platform that may be rigid, semi-rigid, inflatable, pleated, telescoping, floating, cushioned, or flexible. The shelf may be supported by straps that may exit the container and are fastened to, or encircle, the interior and/or exterior of the container. The mechanism for attachment to the outside of the container may be a simple loop over an external anchor point affixed to the outside of the container, or a latch or latches, or a magnetic device, or a continuous loop or loops that encircle the container such that no external anchor is required.

17 Claims, 10 Drawing Sheets

(56) References Cited

U.S. PATENT DOCUMENTS

| | | | | |
|---|---|---|---|---|
| 6,153,857 | A * | 11/2000 | Gunnels | A47J 37/0713 126/220 |
| 6,474,097 | B2 * | 11/2002 | Treppedi | A45C 11/20 280/30 |
| 6,651,456 | B1 * | 11/2003 | White | A47B 31/02 62/457.7 |
| 6,805,225 | B2 * | 10/2004 | Freedman | D06F 95/002 190/112 |
| 6,993,931 | B1 * | 2/2006 | Hamilton | A45B 23/00 62/371 |
| 8,777,042 | B2 * | 7/2014 | Matthews | B65D 25/16 220/495.03 |
| 2006/0144077 | A1 * | 7/2006 | Morris | F25D 3/08 62/459 |
| 2007/0053616 | A1 * | 3/2007 | Plouff | A45C 11/20 383/22 |
| 2008/0237153 | A1 * | 10/2008 | Nicastle | A01K 7/00 210/806 |
| 2013/0153584 | A1 * | 6/2013 | Balleck | F25D 3/08 220/592.01 |

* cited by examiner

ICE CHEST SUSPENSION DEVICE

CROSS REFERENCE TO RELATED APPLICATION

This patent application is a continuation of U.S. patent application Ser. No. 14/994,129, titled "ICE CHEST SUSPENSION DEVICE," filed on Jan. 16, 2016. This patent application claims priority and benefit to U.S. patent application Ser. No. 14/994,129, titled "ICE CHEST SUSPENSION DEVICE," under 35 U.S.C. § 120. Patent application Ser. No. 14/994,129 is herein incorporated by reference in its entirety.

This patent application claims the priority and benefit under 35 U.S.C. § 119(e) of U.S. Provisional Patent Application Ser. No. 62/104,834 filed Jan. 18, 2015, entitled "ICE CHEST SUSPENSION DEVICE." U.S. Provisional Patent Application Ser. No. 62/104,834 is herein incorporated by reference in its entirety.

TECHNICAL FIELD

Embodiments are generally related to containers, environmental enclosures, and/or ice chests. More particularly, embodiments relate to methods and systems for suspending items in an environmental enclosure such as an ice chest.

BACKGROUND

To outdoor enthusiasts and others who wish to convey food, ice chests are a valuable and trusted resource. Ice chests are insulated enclosures that can be used to heat, cool, and/or prevent or delay external environmental conditions from affecting the temperature change of food or other items in the enclosure. Generally, an ice chest is filled with ice and food articles. The ice helps keep the food cold. Foods that are more desirable when cold, and food that would otherwise spoil, if kept at the ambient external temperature can therefore be preserved for later use by placing it in the ice chest.

However, ice chests suffer from several significant problems. One of these is that when the external temperature is above freezing the ice in an ice chest will eventually change to a liquid state. No ice chest provides perfect insulation. The resulting ice water mixture, or eventually water alone, can be a nuisance. For example, it is common to keep raw meats, cheese, or other such food items in a cooler. As the ice melts and phase changes into water, the food is increasingly subject to inundation by the water. This can cause the food (or other items in the ice chest) to spoil or be undesirable for consumption. In addition, the water can be dirty and/or the food can contaminate the water making the cooler unsanitary and potentially unsafe.

For example, it is not uncommon for canned drinks to be held in a cooler with raw meats. When the ice in the cooler melts, the meat and water come in contact. Bacteria and other toxins can then be transported from the meat through the water to the surface of the can where a person might place their mouth. This situation is both unsanitary and unsafe.

Other methods and systems have attempted to remedy this situation in a number of ways. For example, some prior art methods use custom trays to hold items near the top of an ice chest. However, these inventions are often expensive, inconvenient, and not adaptable to multiple ice chest shapes and sizes. Accordingly, there is a need in the art for an adaptable suspension device for use in containers, environmental enclosures, and other containers like ice chests.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for suspending items in a container.

It is another aspect of the disclosed embodiments to provide for an enhanced method and system for suspending items in an ice chest.

It is yet another aspect of the disclosed embodiments to provide methods and systems for an adjustable suspension mechanism to hold food and other items out of, and/or above, a liquid and/or other items in the bottom of an ice chest using thin straps that can be attached to the ice chest, magnets, or other mechanisms.

The aforementioned aspects and other objectives and advantages can now be achieved as described herein. A method, system, and apparatus can comprise a suspended platform configured to fit within an enclosure, a lid to the enclosure, and, at least one strap fixed to the platform wherein the strap is configured to suspend the suspended platform within the enclosure such that the enclosure can be fully closed with the lid.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The particular values and configurations discussed in the following non-limiting examples can be varied and are cited merely to illustrate one or more embodiments and are not intended to limit the scope thereof.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 6:
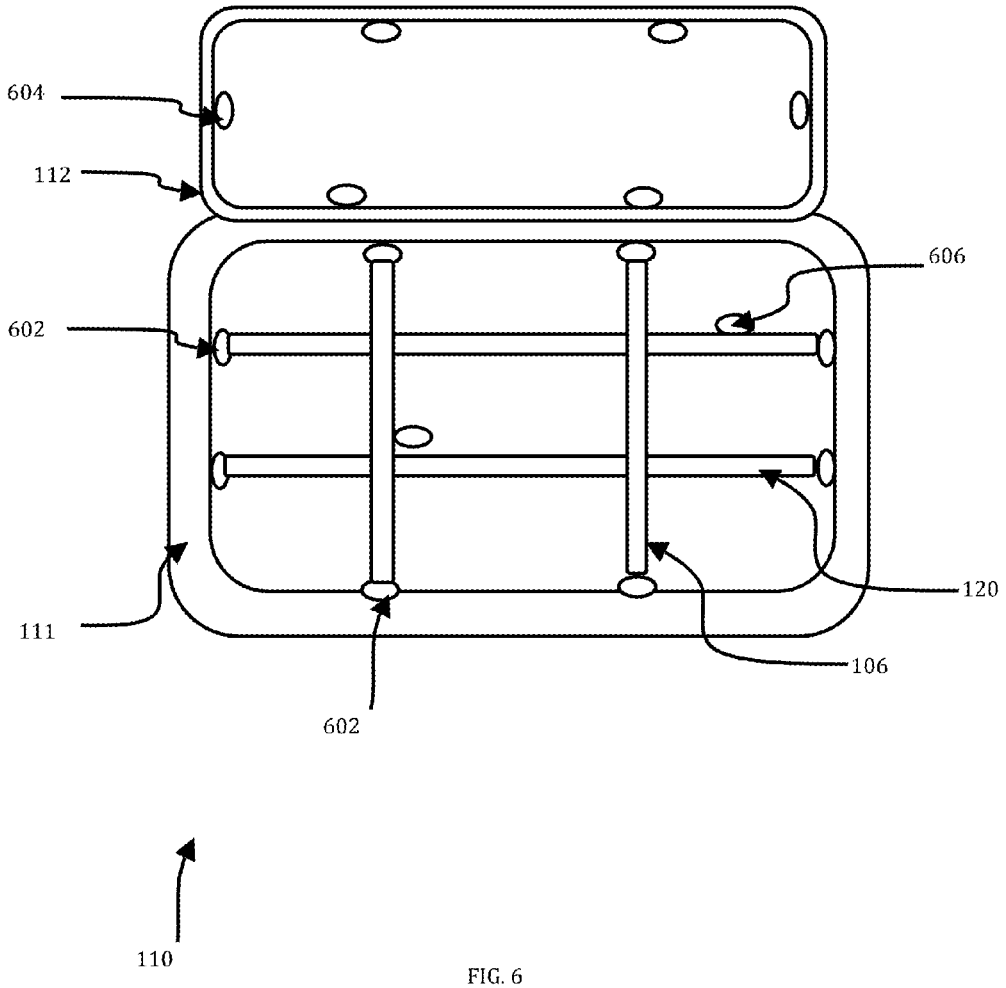
FIG. 6 depicts a view of another embodiment of a system and apparatus for suspending items in an environmental enclosure.

In one embodiment, a system or apparatus 100 for suspending items within a transportable container 110, such as an environmental enclosure like a common "cooler" or "ice-chest" is disclosed. In some embodiments, the suspension may be achieved without requiring penetration or other such destructive modification of the interior and/or exterior walls of the transportable container 110. In other embodiments, penetration of the interior or exterior walls may be necessary. Inside the container 110, items 102 are supported by resting on top of a shelf, hammock, or platform 104 that may be rigid, semi-rigid, inflatable, pleated, telescoping, floating, cushioned, and/or flexible. In other embodiments, the shelf 104 can be embodied as a common household container, including but not limited to a plastic container, pot, re-sealable container, strainer, jar, etc. The shelf 104 may be supported by straps 106 that exit the container 110 and are fastened to, or encircle, the outside of the container 110. The mechanism for attachment to the outside of the container 110 may be a simple loop over an external anchor point affixed to the outside of the container, or a latch or latches, or a magnetic device, or a continuous loop or loops that encircle the container such that no external anchor is required. The shelf may also be attached to internal anchor points, in like manner, as shown in FIG. 6 below.

The straps 106 may have an elastic quality, be of adjustable length, and be flat (to minimize interference with complete closure of the container lid), or any sort of cordage. The straps 106 may also be made of leather, nylon, plastic, rubber, springs string, twine, wire, or other known strap material. The container 110 may be designed to accommodate the straps 106 leading to the external part of the container 110 to minimize interference with full closure of the container 110 when the lid 112 is closed.

The internal platform 104 may be flexible to allow ready access to items below the platform 104 by simply pushing the platform 104 to the side. For example, the internal platform 104 may be a net that holds items above water or ice in the bottom of the container 110 to keep the items 102 from getting wet. The internal platform 104 may have a rim 114 that define the top edge or edges of the platform and may restrain items from falling off the platform during transport.

The internal platform 104 may have compartments defined by dividers 116 to keep items 102 from unintentional mixing. The dividers 116 can run in any direction within the container 110. In addition, the platform 104 may include at least one brace 120. The brace 120 is used to hold the platform 104 spread open while items are being held by the platform 104. The braces 120 may be formed of flexible, or telescoping members that can be extended and retracted as desired. The expansion or retraction of braces 120 allows the platform 104 width to be adjusted. If a user wishes to access items below the platform 104 the braces 120 can be retracted so that the platform 104 can be moved aside. The braces 120 can therefore operably engage with rim 114 via, clips, snaps, etc. In one embodiment, the braces 120 can be biased by springs or other means to draw in the rim 114 of the platform 104. In this embodiment, the braces 120 can include a locking mechanism 122 to hold the braces 120 in extension, retraction, or in a neutral position when desired.

Container 110 may generally be formed with handles 118. The straps 106 can be formed with loops, which wrap around or otherwise connect with handles 118. The tension in strap 106 is facilitated by their engagement with the handles 118. The straps 106 may further engage with the rim 114, braces 120, and/or platform 104. The straps 106 engagement with the rim 114, braces 120, and/or platform 104 suspends the platform 104 above other material in the container 110.

In another embodiment, an expandable rigid, or semi-ridged band 124 can be wedged to fit along the internal sidewalls of container 110 to create an artificial lip, shelf, or anchor for other devices. The band 124 can be expandable or retractable to fit at a desired elevation inside the container 110. The band 124 can be magnetic, can be formed with anchors, and can include connecting means for straps 106, brace 120, or platform 104.

Figure 1:
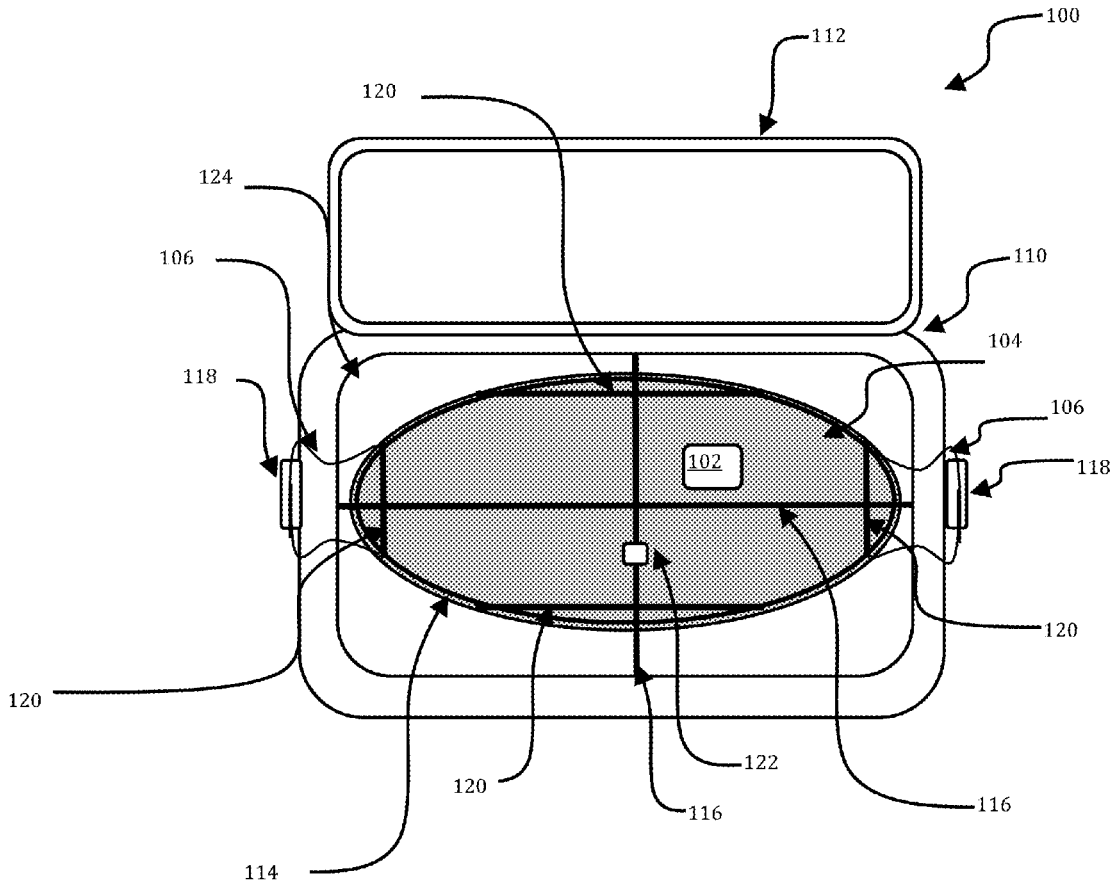
FIG. 1 depicts a system or apparatus for suspending items in an environmental enclosure, in accordance with an embodiment of the invention.
Figure 2:
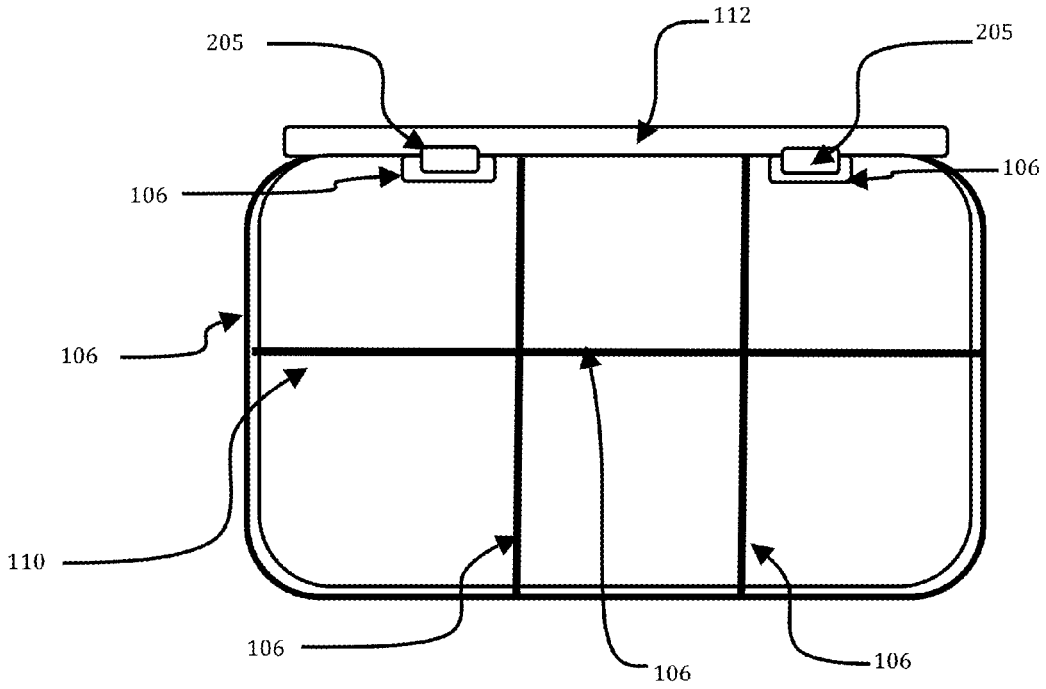
FIG. 2 depicts a rear view of a system and apparatus for suspending items in an environmental enclosure, in accordance with an embodiment.

FIG. 2 illustrates a rear view of a container 110, with lid 112 closed. This view illustrates straps 106 exiting the container 110 under lid 112. The straps 106 can be formed to be thin, and perhaps uniquely thin, nominally 1 mm or less, at the points where they run between the lid 112 and container 110. To that end the straps 106 can be tapered at such points. The straps 106 can be wrapped around the sides of the container 110 and/or down the front and back sides of the container 110. The individual straps 106 can engage with other straps 106 via clips, stitches, hook and loop, glue, buttons, snaps, magnets, or other such known means of attachment. The straps' interactions can be used to maintain tension to suspend the platform in the container. Additionally, straps 106 can loop around hinges 205 that operatively connect lid 112 to container 110.

Figure 3:
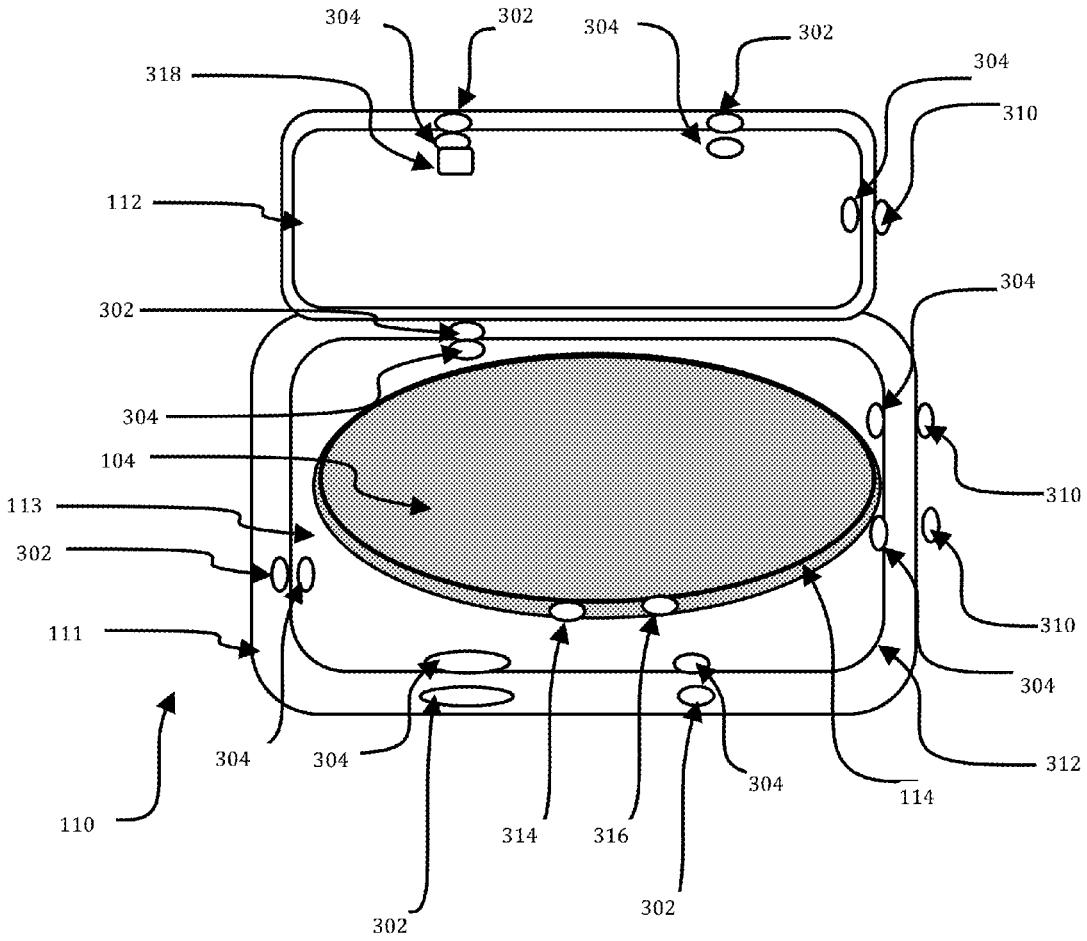
FIG. 3 depicts a top view of another embodiment of a system and apparatus for suspending items in an environmental enclosure, in accordance with an embodiment.

FIG. 3 illustrates an embodiment wherein a magnet or series of magnets are employed as a suspension system. The magnets disclosed herein may be rare earth magnets, electromagnets, bar magnets, bead magnets, strip magnets, segmented magnets, cylindrical magnets, sheet magnets, flexible magnets, or other such known magnets. The suspension system can be used to hold any item 102 in the container 110, but is preferably used to hold platform 104. Magnets 302 can be formed inside the walls 111 of container 110. Any number of magnets 302 can be formed at any elevation in the walls 111 of container 110 depending on design considerations. Magnets can also be installed in the lid 112 of container 110, or floor 113 if desired. Magnets 304 can be arranged proximately to magnets 302, such that they experience an attractive magnetic force. The attraction between magnets 302 and magnets 304 can hold the magnets 304 in the container 110. This allows any number of hooks, braces 120, platform 104, anchors 318 or other such devices to be connected with magnets 304 and thereby also held in or attached to container 110. In this embodiment, it is preferred to have markings on, or indentations in the walls 111 of container 110 that indicate where magnets 302 are located. Magnets 302 may also be embodied as magnetic strips, magnetic rods, or other such magnetic devices, running throughout the walls 111 of the container 110.

In another embodiment the inner and/or outer walls 111 of container 110, floor 113, and lid 112 may comprise a sheet magnet 312. Magnets 304 and 310 can then be fixed at any location within the container 110. Likewise, the magnets 304 and 310 may be placed at any external location on the container 110. The sheet magnet 312 may also be formed inside walls 111 if desired.

In another embodiment, the magnets 302 can be formed to be attracted to magnets 310 which are placed on the exterior of container 110. Magnets 310 can be permanently fixed to the exterior of container 110, or may be held in place via magnetic attraction. The attraction between magnets 304 and 310 can be used to hold both magnets 304 and 310 on the interior and exterior of the container respectively. Various items 318 can then be attached to magnets 304 and/or 310. As above, any number of hooks, braces 120, platform 104, or other such devices to be connected with magnets 304 and thereby also held in container 110. Magnets 304 and 310 offer the additional advantage that they can be retrofitted on a container 110 that was not originally designed with internal magnets 302.

In another embodiment, magnets 310 can be embodied as screws, rivets, nails, nuts, bolts, or other such devices which can penetrate the external walls of container 110. For example, handles 118 may be connected to container 110 using screws. These screws can be magnetized in order to serve as magnets 310. In this way, the magnetic attraction to magnet 304 is amplified because the distance separating magnets 304 and magnets 310 is decreased.

In another embodiment, platform 104 can be formed with magnets 314, which are attracted either to internal magnets 302, magnets 304, sheet magnets 312 or to magnets 310. The magnetic attraction can be used to suspend platform 104, or multiple platforms 104, above or below other items in the container 110. Additionally, the various magnets disposed throughout the container 110 or on the exterior of container 110 allow platform 104, or multiple platforms 104, to be arranged at varying elevations, locations, and angles throughout container 110, offering the user additional configurability.

In yet another embodiment the rim 114 affixed to platform 104 can be formed of a magnetic strip, may have magnets 314 affixed to it, or may contain a plurality of magnets 316, such that the magnets are integrated into the platform 104. Magnets 314 and magnets 316 can be configured to be attracted to magnets 302, magnets 310, or sheet magnets 312 in order to facilitate suspension of the platform 104 as above.

Figure 4A:
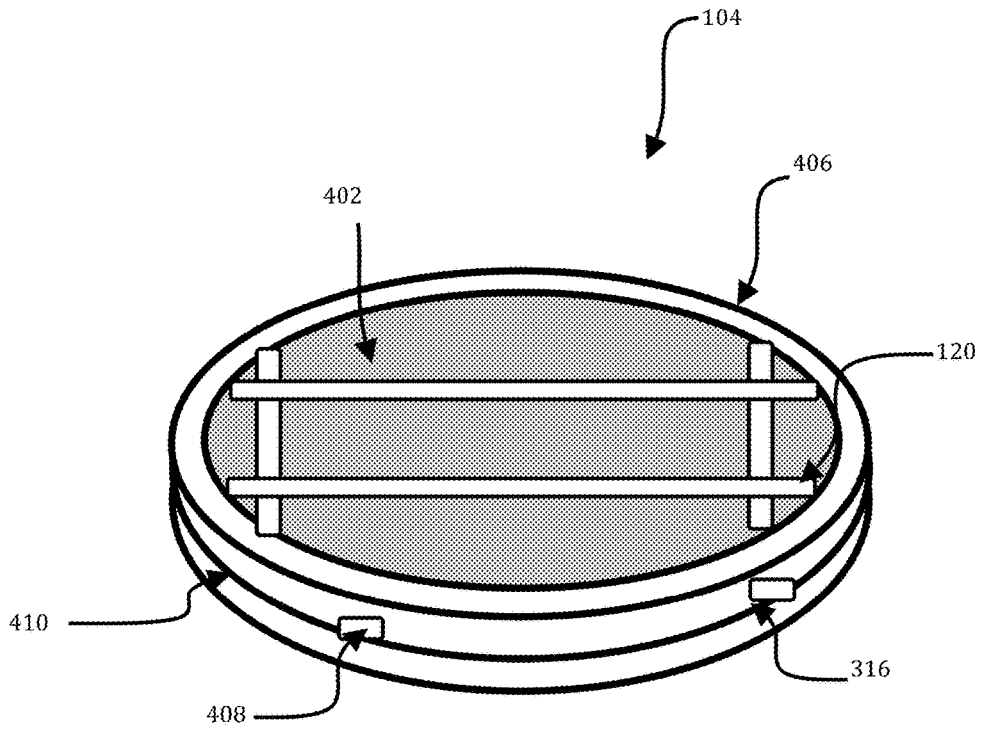
FIG. 4A depicts a suspending device in accordance with an embodiment.

FIG. 4A illustrates an embodiment of the platform 104. The platform 104 generally can include a suspending material 402. The suspending material may preferably be a mesh nest or wire basket, but may also be plastic, metal, rubber, stitched fiber, chain linked material, stitched or woven plastic, wood, latex, washable fabric, or such material. It is preferable for the suspending material 402 to be washable. The suspending material 402 is also preferably elastic so that it can be stretched, expanded, or retracted into different shapes as necessary to allow a user to access items in the container 110.

The platform 104 can include rim 114, which can further comprise a buoyant material. Rim 114 can alternatively be formed of a fabric sleeve with an internal ridged or semi-rigid member 410. Internal member 410 may be manipulated as desired into a shape defining the edges of the platform 104. Rim 114 can also be formed of a sleeve with a magnet or plurality of magnets 316 therein.

The rim 114 is fixedly connected to suspending material 402. The rim 114 can include fasteners 408 that connect with straps 106. Fasteners 408 can be formed as snaps, buttons, clips, Velcro, ties, loops, or other known fastening devices. Rim 114 can also have on or more integrated magnets 316 or can have an integrated strip magnet 406. Flexible braces 120 can be formed across, or integrated in suspending material 402 and can fixedly connect with rim 114.

Figure 4B:
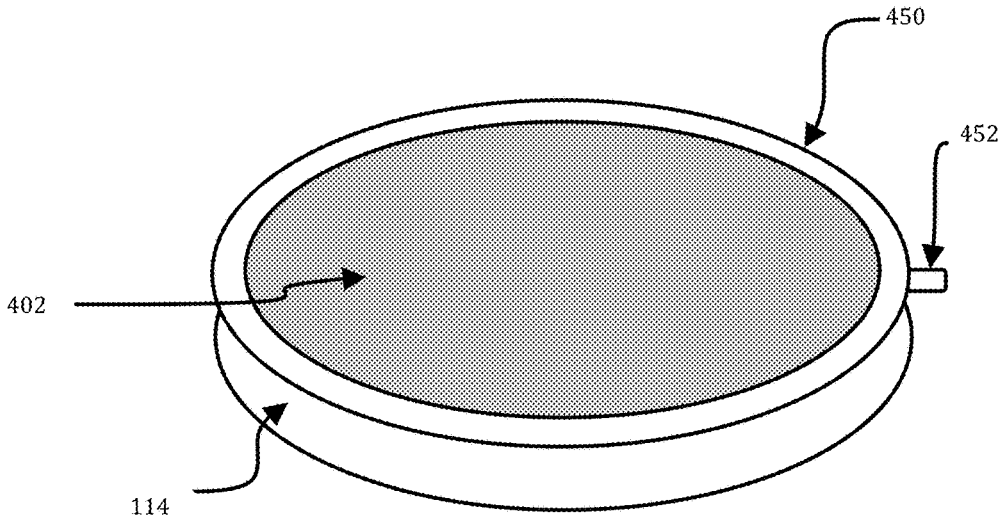
FIG. 4B depicts a suspending device in accordance with another embodiment.

FIG. 4B illustrates an embodiment wherein the rim 114 is an air-filled compartment 450. In this embodiment, the rim 114/and or platform 104 can be formed with a durable exterior material and an air proof bladder that can be filled with air. An air valve 452 provides a uni-directional, or bi-directional valve that allows a user to fill the air proof bladder with air. In this embodiment, the rim may still include magnets 316, magnetic strip 406, connectors 408 and internal member 410.

Figure 5:
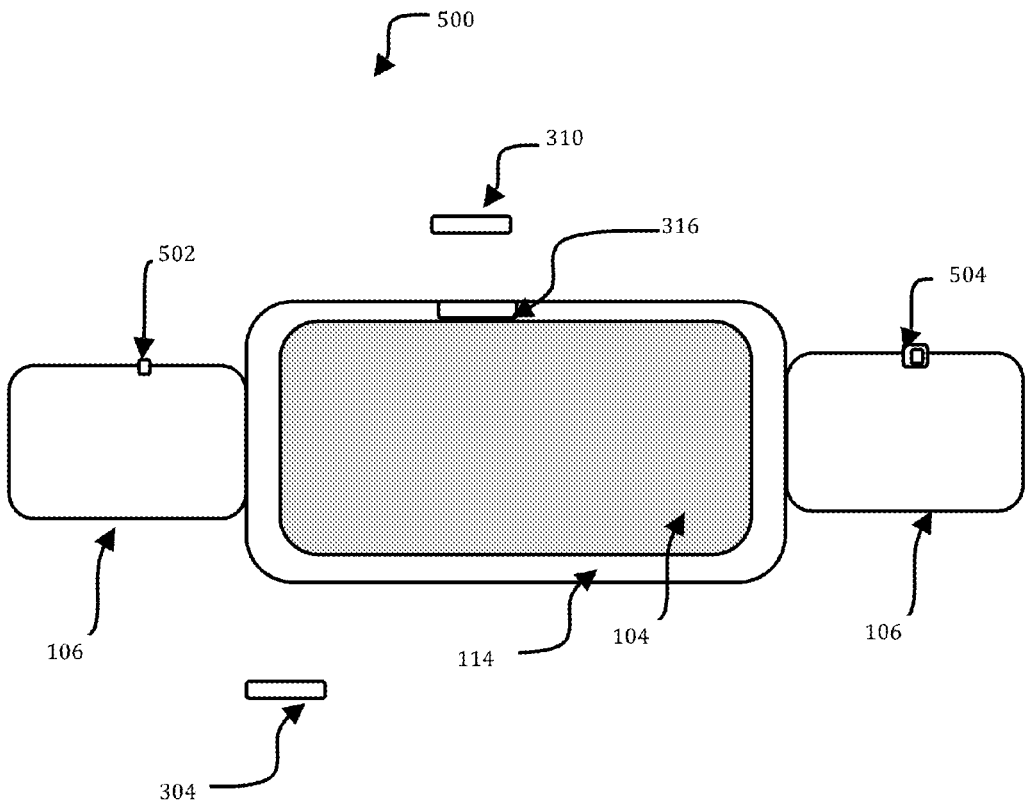
FIG. 5 depicts a top view of a suspending device in accordance with an embodiment.

FIG. 5 illustrates an embodiment of a portable suspension system 500 comprising any of straps 106, platform 104, rim 114, magnets 310, and magnets 304. It should be appreciated that, in this embodiment rim 114 and/or platform 104, and/or straps 106, and/or braces 102 may be fitted with magnets 314, magnets 316 (or magnetic strip 406) and magnets 310, and/or straps 106. Straps 106 can be connected with rim 114 and rim 114 is formed to hold suspending material 402 and optionally braces 120. The rim 114 can include internal member 410 which allows the rim to be manipulated to from desired shapes.

The straps 106 can be wrapped around a container, such as container 110, in order to suspend the system 500 in the container. The straps can be fixed with one or more buckles 502 so that the two loose ends of the strap can be joined to from a loop. The straps 106 can also be fitted with one or more tensioning devices 504 so that the straps can be tightened around, for example, the exterior of a container 110, the handles of a container, the hinges of the container, a spout on the container, internal or external anchors on the container, or mounts held in place by magnets on the container. The tensioning devices 504 may be springs which are formed in, or connected to, straps 106. Straps 106 may also comprise magnetic strips. The system 500 can alternatively be suspended by arranging magnets 316 (or magnetic strip 406), to align with magnets 310, or with magnets 302, such that the force between the magnets suspends the system in a container.

FIG. 6 illustrates an embodiment of the invention wherein a series of anchors are formed in or on the walls 111 of container 110. The anchors may be wall anchors 602 formed in or on the walls 111 of container 110, lid anchors 604 formed in or on the lid 112 of container 110, and floor anchors 606 formed in or on the floor of container 110. The anchors may be any connecting means affixed to the container, or may be embodied as open-faced indentions with lips, rings, or other known anchoring means for holding structural members, such as braces 120. The anchors may also be used for holding straps 106 as illustrated above.

Figure 7:
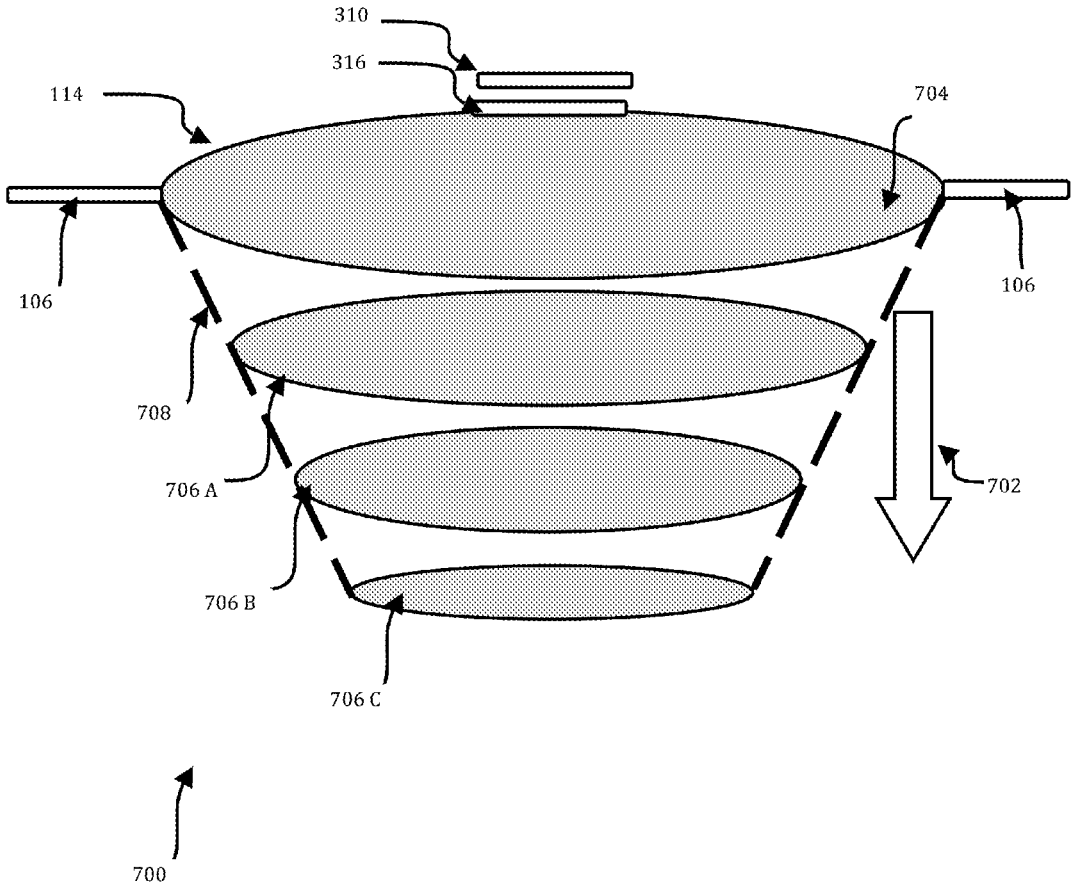
FIG. 7 depicts a platform system associated with a system for suspending items in an environmental enclosure, in accordance with another embodiment.

FIG. 7 illustrates another embodiment of a system and apparatus 700 for suspending items in a container. In this embodiment, a platform (such as platform 104) is expandable as illustrated by arrow 702. System 700 may be suspended by straps 106 and/or magnets 310, magnets 314, magnets 316, magnets 304, and magnets 302 as disclosed above. System 700 may also or alternatively be suspended with braces such as braces 120.

In this embodiment rim 114 may comprise an expandable frame 708 and may act as an expandable basket 704. It should be appreciated that the shape of frame 708 and basket 704 may vary. The shape may be defined by the manipulatable member which may run through rim 114 and may further be used to define the shape of basket 704. The shape of the platform 104 and/or basket 704 may be adjusted or self-adjust as the phase change of a cooling material (such as ice), and/or the addition, removal, or shifting of items in the basket 704 occurs. The basket 704 may have multiple trays or levels, such as levels 706 A-C. Each of levels 706 may be formed of a suspending material preferably a mesh net, but may also be plastic, metal, rubber, stitched fiber, chain linked material, stitched or woven plastic, wood, latex, washable fabric, a system of springs, or other such material. As described above, the structure of basket 704 and rim 114 allows the basket to be, for example, pushed aside so items in a container can be readily accessed.

Figure 8:
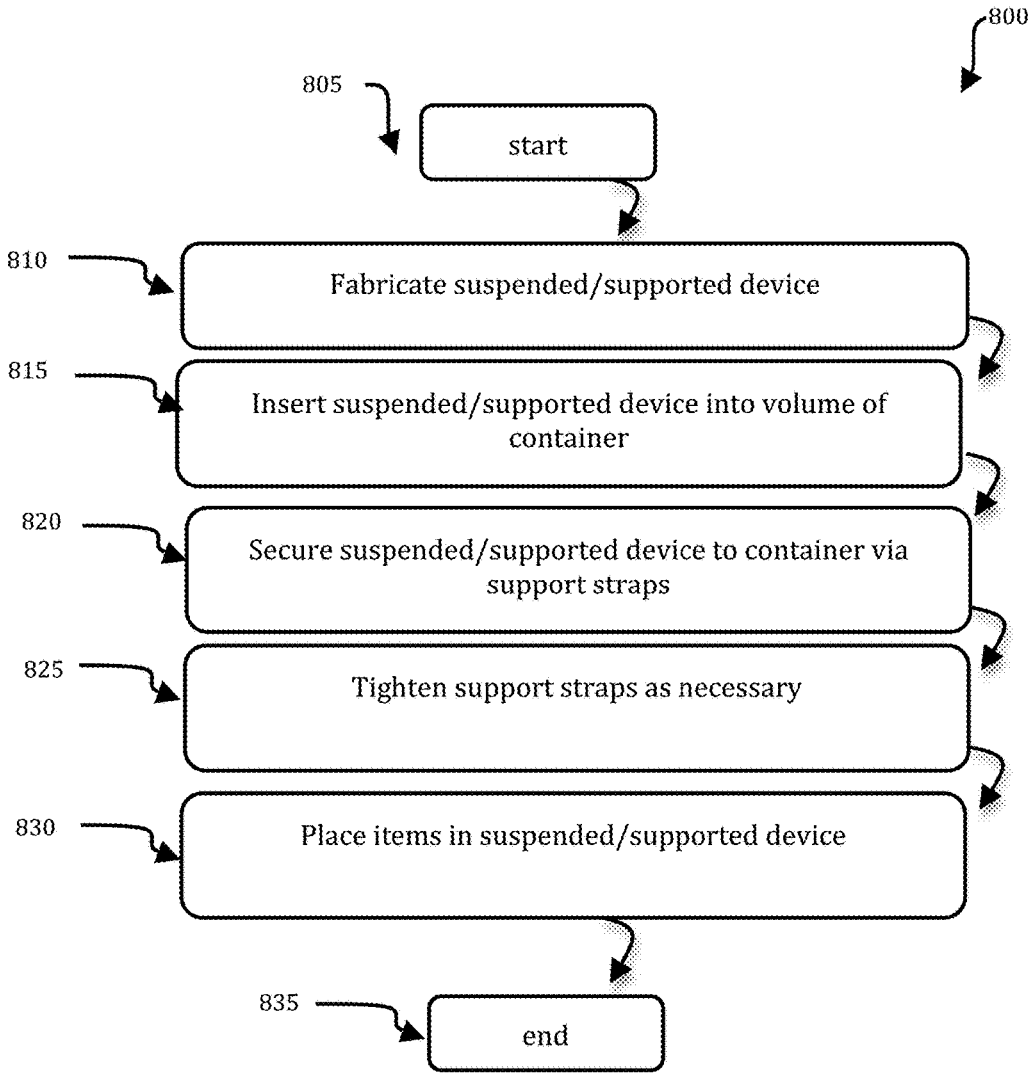
FIG. 8 depicts a high-level flow chart illustrating steps for suspending food in an environmental enclosure, in accordance with another embodiment.

FIG. 8 illustrates steps associated with a method 800 for suspending items in a container. The method begins at 805. At 810 a device comprising any of a platform, rim, and suspension means can be fabricated. At step 815, the platform is inserted into the volume defined by a container. The straps can then be used to secure and suspend the platform and rim inside the volume of the container as illustrated by 820. The straps may need to be adjusted to maintain the proper tension to suspend the platform and rim when items are placed thereon and create a load, as shown at 825. Items can now be placed on the platform as shown by 830 and the container can be closed. The method then ends at step 835.

Figure 9:
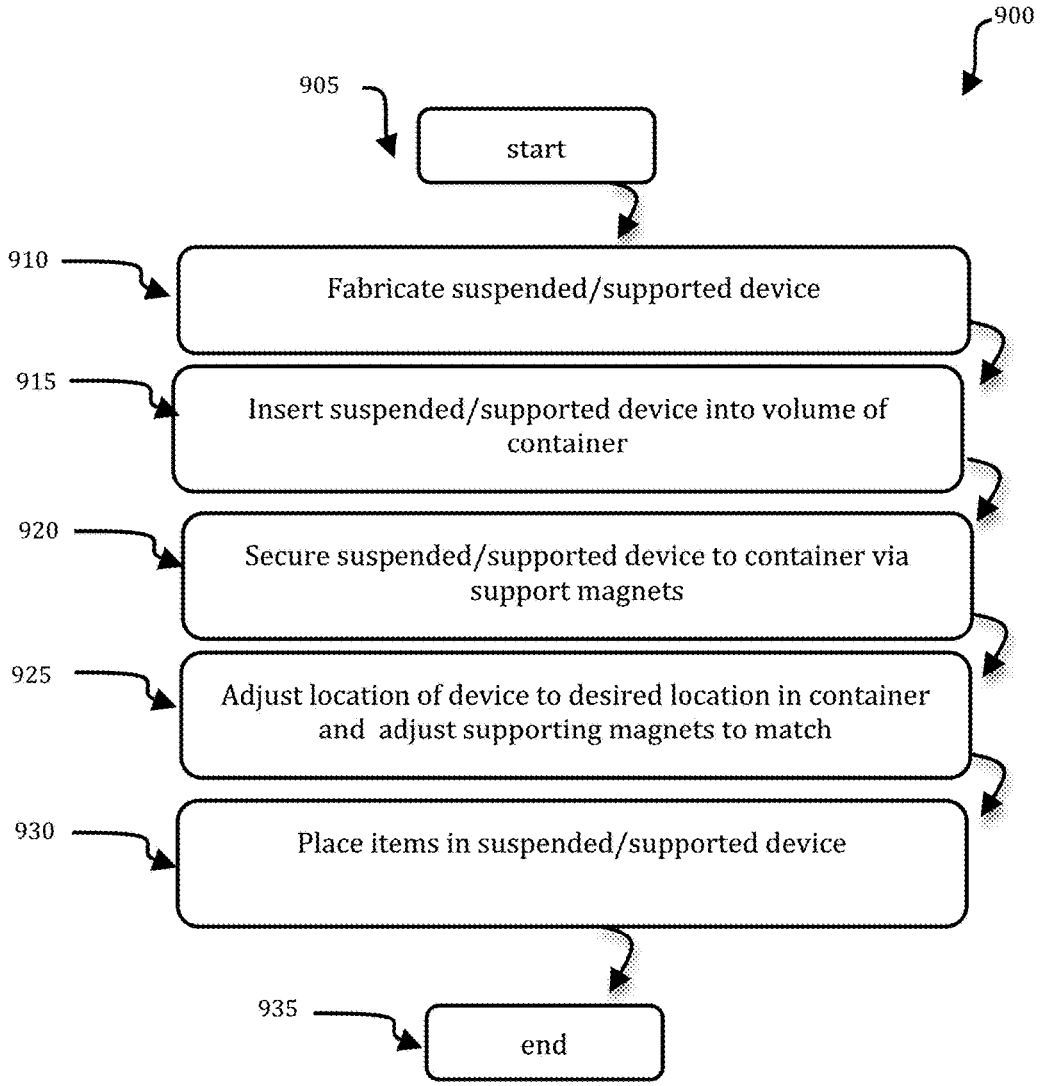
FIG. 9 depicts a high-level flow chart illustrating steps for suspending food in an environmental enclosure, in accordance with another embodiment.

FIG. 9 illustrates steps associated with another method 900 for suspending items in a container. The method begins at 905. At 910 a device comprising a platform, a rim, and suspension means can be fabricated. At step 915, the platform is inserted into the volume defined by a container. Next the platform can be secured to the container by aligning magnets connected to, or integral in the rim or platform, with oppositely biased magnets on the outer surface of, or integral in, the container as shown at 920. At 925, the location of the platform can be adjusted to the desired elevation, location, and angle in the container. The location of the oppositely biased magnets internal, external, or integral to the container may need to be adjusted to supply sufficient magnetic attraction between the magnets to suspend the platform. Items can now be suspended or supported on the platform as shown by 930. The method ends at 935.

Figure 10:
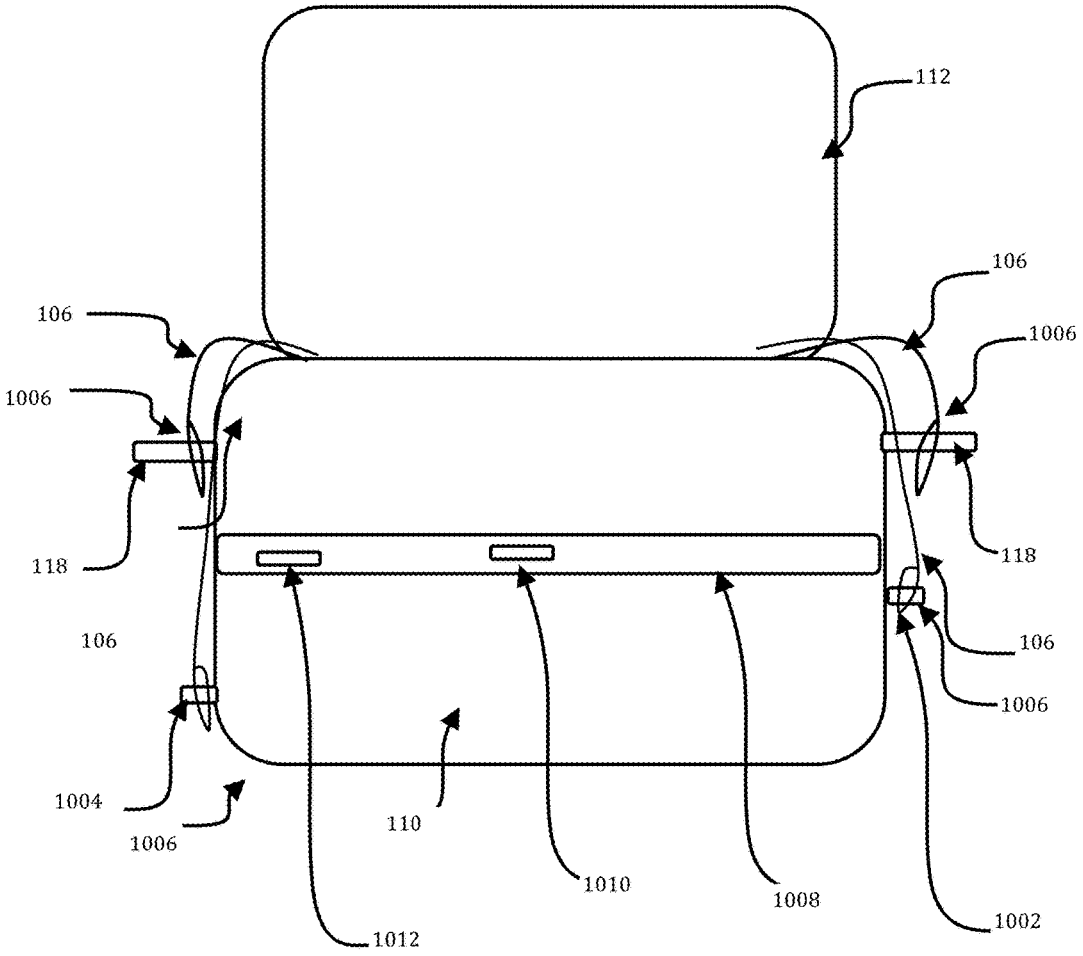
FIG. 10 depicts a front view of a system and apparatus for suspending items in an environmental enclosure, in accordance with another embodiment.

FIG. 10 illustrates another embodiment wherein straps 106 may be used to connect with external anchors 1002, handles 118, drain valve 1004, or other external attachment points associated with container 110 via strap loops 1006. As illustrated in FIGS. 1-9 above, straps 106 can be used to suspend a platform in a container 110. Straps 106 can, in addition to features shown above, can include strap loops 1006. These strap loops 1006 can be wrapped around external features on the container such as external anchors 1002, or a drain valve 1004, which may commonly be found on ice chests. Additionally, strap loops 1006 can be wrapped around handle 118. Additional straps 1008 can be fitted with additional anchors 1010, or additional magnets 1012 which may then be used to provide additional external anchors 1010 for straps 106 to connect with. Once the strap loops 1006 have been engaged around one of these features, the strap tension can be increased via tensioning devices such as tensioning device 504.

Based on the foregoing, it can be appreciated that a number of embodiments, preferred and alternative, are disclosed herein. For example, in one embodiment, an apparatus can comprise a suspended platform configured to fit within an enclosure, a lid to the enclosure, and, at least one strap or rod fixed to the platform wherein the strap or rod is configured to suspend the suspended platform within the enclosure such that the enclosure can be fully closed with the lid.

In an embodiment, a suspension system comprises a suspended platform configured to fit within an enclosure; a lid to the enclosure; and at least one strap or rod fixed to the platform wherein the strap or rod is configured to suspend the suspended platform within the enclosure such that the enclosure can be fully closed with the lid. The strap comprises at least one of a nylon strap; a cloth strap; a leather strap; a semi-rigid or rigid rod; a plastic strap; a rubber strap; an elastic strap; and a cargo mesh strap.

In another embodiment, the suspension system further comprises at least one attachment member formed on an inner or outer surface of the enclosure wherein the at least one strap or rod is formed to engage with the at least one attachment member in order to suspend the suspended platform within the enclosure. The at least one attachment member comprises at least one of: a handle; a drain valve; an external fixture; an internal fixture an internal anchor; and an external anchor.

In another embodiment, the system comprises a first side of the at least one strap or rod formed to connect to a first side of the platform; a middle portion of the at least one strap or rod formed to encircle an interior or exterior anchor of the enclosure; and a second side of the at least one strap or rod formed to connect to a second side of the platform.

In another embodiment of the system the platform comprises at least one of: a cargo mesh; a flexible substrate; a flexible rubber platform; a flexible plastic platform; and a cloth platform.

In another embodiment, the system further comprises: an expandable rim formed in an outer diameter of the platform. the platform is configured to be expandable in three dimensions. In another embodiment, the system further comprises a buoyant rim formed in an outer diameter of the platform.

In another embodiment, the system further comprises: at least one buckle associated with the at least one strap or rod; and at least one strap or rod tensioning attachment member associated with the at least one strap or rod.

In another embodiment, an apparatus for suspending items in an enclosure comprises a suspended platform configured to fit within the enclosure; a lid to the enclosure; and at least one strap or rod fixed to the platform wherein the strap or rod is configured to suspend the suspended platform within the enclosure such that the enclosure can be fully closed with the lid thereby preventing an item held in the platform from contaminating a liquid in the enclosure. In an embodiment, the enclosure comprises an ice chest.

In another embodiment, the strap comprises at least one of: a nylon strap; a cloth strap; a leather strap; a semi-rigid or rigid rod; a plastic strap; a rubber strap; a cargo mesh strap.

In another embodiment, the apparatus comprises at least one attachment member formed on an inner or outer surface of the ice chest wherein the at least one strap or rod is formed to engage with the at least one attachment member in order to suspend the suspended platform within the ice chest.

In another embodiment, the apparatus the at least one attachment member comprises at least one of: a handle; a drain valve; an internal fixture; an internal anchor; an external fixture; and an external anchor.

In another embodiment, the platform comprises at least one of: a cargo mesh; a flexible substrate; a flexible rubber platform; a flexible plastic platform; and a cloth platform.

In another embodiment, the apparatus further comprises an expandable rim formed in an outer diameter of the platform wherein the platform is configured to be expandable in three dimensions and is configured to be buoyant.

In yet another embodiment, a method for suspending items in an enclosure comprises disposing a platform in the enclosure; connecting at least one strap or rod fixed to the platform to at least one internal or external attachment member such that a lid of the enclosure can be fully closed. Connecting at least one strap or rod to at least one internal or external attachment member further comprises: sliding a loop at an end of the at least one strap around a first internal or external attachment member; sliding a loop at an end of the at least one other strap or rod around a second internal or external attachment member; and adjusting the tension in the at least one strap or rod using a tensioning mechanism and adjusting the tension in the at least one other strap or rod using a second tensioning mechanism thereby suspending the platform in the enclosure. The at least one internal or external attachment member comprises at least one of: a handle; a drain valve; an internal fixture; an internal anchor; an external fixture; and an external anchor.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A suspension system comprising:
a suspended platform configured to fit within an enclosure;
at least one strap fixed to said suspended platform; and
at least one attachment member formed on an external vertical wall of said enclosure wherein said at least one strap engages with said at least one attachment member;
wherein said strap is configured to extend outside said enclosure and suspend said platform within said enclosure such that said enclosure can be fully closed with a lid.

2. The suspension system of claim 1 wherein said strap comprises at least one of:
a nylon strap;
a cloth strap;
a leather strap;
a plastic strap;
a rubber strap;
an elastic strap; and
a cargo mesh strap.

3. The suspension system of claim 1 wherein said at least one attachment member comprises at least one of:
a handle;
a drain valve;
an external fixture; and
an external anchor.

4. The suspension system of claim 3 further comprising:
a first side of said at least one strap formed to connect to a first side of said platform;
a portion of said at least one strap formed to encircle at least one of said handle, said drain valve, said external fixture, and said external anchor; and
a second side of said at least one strap formed to connect to a second side of said platform.

5. The suspension system of claim 1 further comprising:
a first side of said at least one strap formed to connect to a first side of said platform;
a middle portion of said at least one strap formed to encircle an exterior of said enclosure; and
a second side of said at least one strap formed to connect to a second side of said platform.

6. The suspension system of claim 1 wherein said platform comprises at least one of:
a cargo mesh;
a flexible substrate;
a flexible rubber platform;
a flexible plastic platform; and
a cloth platform.

7. The suspension system of claim 1 further comprising a flexible rim formed in an outer diameter of said platform.

8. The suspension system of claim 1 wherein said platform is configured to be expandable in three dimensions.

9. The suspension system of claim 1 further comprising:
at least one fastener associated with said at least one strap; and
at least one strap tensioning member associated with said at least one strap.

10. An apparatus comprising:
a suspended platform configured to fit within an enclosure;
at least one strap fixed to said suspended platform; and
at least one attachment member formed on an external vertical wall of said enclosure wherein said at least one strap engages with said at least one attachment member;
wherein said strap is configured to extend outside said enclosure and suspend said platform within said enclosure such that said enclosure can be fully closed with a lid.

11. The apparatus of claim 10 wherein said enclosure comprises an ice chest.

12. The apparatus of claim 10 wherein said strap comprises at least one of:
a nylon strap;
a cloth strap;
a leather strap;
a plastic strap;

a rubber strap;
a cargo mesh strap;
string;
twine; and
wire.

13. The apparatus of claim 10 wherein said at least one attachment member comprises at least one of:
a handle;
a drain valve;
an external fixture; and
an external anchor.

14. The apparatus of claim 13 further comprising:
a first side of said at least one strap formed to connect to a first side of said platform;
a portion of said at least one strap formed to encircle at least one of said handle, said drain valve, said external fixture, and said external anchor; and
a second side of said at least one strap formed to connect to a second side of said platform.

15. The apparatus of claim 10 further comprising:
a first side of said at least one strap formed to connect to a first side of said platform;
a middle portion of said at least one strap formed to encircle an exterior of said enclosure; and
a second side of said at least one strap formed to connect to a second side of said platform.

16. A method for suspending items in an enclosure comprising:
disposing a platform in said enclosure, said enclosure further comprising a lid;
suspending said platform in said enclosure with at least one strap, said at least one strap connected to said platform;
extending said at least one strap outside of said enclosure such that said lid of said enclosure can be fully closed; and
connecting said at least one strap to at least one attachment member formed on an external vertical wall of said enclosure.

17. The method of claim 16 further comprising:
adjusting tension in said at least one strap with a strap tensioning member.

* * * * *